US011506991B2

(12) United States Patent
Choi et al.

(10) Patent No.: US 11,506,991 B2
(45) Date of Patent: Nov. 22, 2022

(54) STORING INFORMATION IN TONER REFILL KIT DURING TONER REFILL

(71) Applicant: Hewlett-Packard Development Company, L.P., Spring, TX (US)

(72) Inventors: Hong-Chul Choi, Seongnam-si (KR); Yun-Su Kim, Seongnam-si (KR); Seong-ho Jin, Seongnam-si (KR); Jinwoo Noh, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/273,385

(22) PCT Filed: Dec. 6, 2019

(86) PCT No.: PCT/US2019/064940
§ 371 (c)(1),
(2) Date: Mar. 4, 2021

(87) PCT Pub. No.: WO2020/242525
PCT Pub. Date: Dec. 3, 2020

(65) Prior Publication Data

US 2022/0050403 A1 Feb. 17, 2022

(30) Foreign Application Priority Data

May 24, 2019 (KR) ..... 10-2019-0061394

(51) Int. Cl.
*G03G 15/08* (2006.01)
*B41J 2/00* (2006.01)
(Continued)

(52) U.S. Cl.
CPC ..... *G03G 15/0863* (2013.01); *B41J 2/17546* (2013.01); *G03G 15/0867* (2013.01);
(Continued)

(58) Field of Classification Search
CPC ..... G03G 15/0863; G03G 15/0867; G03G 2215/066; G03G 2215/0673;
(Continued)

(56) References Cited

U.S. PATENT DOCUMENTS 6,212,338 B1 * 4/2001 Hagihara ..... G03G 15/0863 399/46
11,209,762 B2 * 12/2021 Lim ..... G03G 15/0879
(Continued)

FOREIGN PATENT DOCUMENTS

CN 100422869 C 10/2008
CN 108363281 A 8/2018
(Continued)

*Primary Examiner* — Robert B Beatty
(74) *Attorney, Agent, or Firm* — Jefferson IP Law, LLP

(57) ABSTRACT

An example operation method of an image forming apparatus includes determining a state of a toner refill operation of injecting toner from a toner reload kit (TRK) into a
(Continued)

cartridge in the image forming apparatus, based on completion of injecting toner from the TRK into the cartridge, controlling the TRK to store information indicating a toner refill completion in a memory of the TRK and updating information of an amount of remaining toner of the cartridge based on an amount of the toner injected into the cartridge from the TRK.

17 Claims, 12 Drawing Sheets

(51) Int. Cl.
*G03G 15/00* (2006.01)
*B41J 2/175* (2006.01)

(52) U.S. Cl.
CPC ..... *G03G 15/0894* (2013.01); *G03G 15/556* (2013.01); *B41J 2002/17579* (2013.01); *G03G 2215/066* (2013.01); *G03G 2215/0673* (2013.01); *G03G 2215/0697* (2013.01)

(58) Field of Classification Search
CPC ..... G03G 2215/0695; G03G 2215/0697; B41J 2/17506; B41J 2/17509; B41J 2/17543; B41J 2/17546; B41J 2/17579
USPC ..... 399/27, 258, 262; 347/86, 87
See application file for complete search history.

(56) References Cited

U.S. PATENT DOCUMENTS

| | | | | |
|---|---|---|---|---|
| 2003/0118355 | A1 | 6/2003 | Guy et al. | |
| 2004/0131392 | A1 | 7/2004 | Matsumoto et al. | |
| 2009/0153602 | A1* | 6/2009 | Brown | B41J 2/17546 347/7 |
| 2011/0097094 | A1 | 4/2011 | Hamano et al. | |
| 2021/0080871 | A1* | 3/2021 | Lee | G03G 15/0894 |

FOREIGN PATENT DOCUMENTS

| | | | | | |
|---|---|---|---|---|---|
| EP | 1041455 | A2 | | 10/2000 | |
| EP | 1400869 | A1 | | 3/2004 | |
| JP | 2001-117380 | A | | 4/2001 | |
| JP | 2001-315323 | A | | 11/2001 | |
| JP | 2003-149929 | A | | 5/2003 | |
| JP | 2004-101670 | A | | 4/2004 | |
| JP | 2005-231250 | A | | 9/2005 | |
| JP | 2005-326772 | A | | 11/2005 | |
| JP | 2013-195923 | A | | 9/2013 | |
| JP | 2018171842 | A | * | 11/2018 | B41J 2/17509 |
| KR | 10-0738948 | B1 | | 7/2007 | |
| KR | 10-2008-0104083 | A | | 11/2008 | |
| KR | 10-0920539 | B1 | | 10/2009 | |
| KR | 10-1076035 | B1 | | 10/2011 | |
| WO | WO-2019208874 | A1 | * | 10/2019 | G03G 15/0863 |
| WO | WO-2020009277 | A1 | * | 1/2020 | G03G 21/1892 |
| WO | WO-2020009280 | A1 | * | 1/2020 | G03G 15/0867 |
| WO | WO-2020046417 | A1 | * | 3/2020 | G03G 15/0867 |
| WO | WO-2020149984 | A1 | * | 7/2020 | G03G 15/0865 |
| WO | WO-2020251618 | A1 | * | 12/2020 | G03G 15/80 |

* cited by examiner

STORING INFORMATION IN TONER REFILL KIT DURING TONER REFILL

BACKGROUND

An image forming apparatus using an electrophotographic method supplies a toner to an electrostatic latent image formed on a photoconductor to form a visible toner image on the photoconductor and transfers the toner image through an intermediate transfer medium or directly to a print medium, and then fixes the transferred toner image on the print medium.

That is, the image forming apparatus uses the toner to print the toner image on the print medium. Because the toner is used every time an image forming job proceeds, the toner is exhausted when used for a predetermined time or more. In this case, a component storing the toner may be exchanged, or the toner may be refilled to the component storing the toner.

DETAILED DESCRIPTION

An "image forming apparatus" described herein may be any type of apparatus capable of performing an image forming job, such as a printer, a scanner, a fax machine, a multi-function printer (MFP), or a display apparatus. The "image forming job" may be at least one job of printing, scanning, and faxing.

Examples are described in detail herein with reference to the accompanying drawings such that the disclosure may be easily performed by one of ordinary skill in the art to which the disclosure pertain. The disclosure may, however, be embodied in many different forms and should not be construed as being limited to the examples set forth herein.

Figure 1:
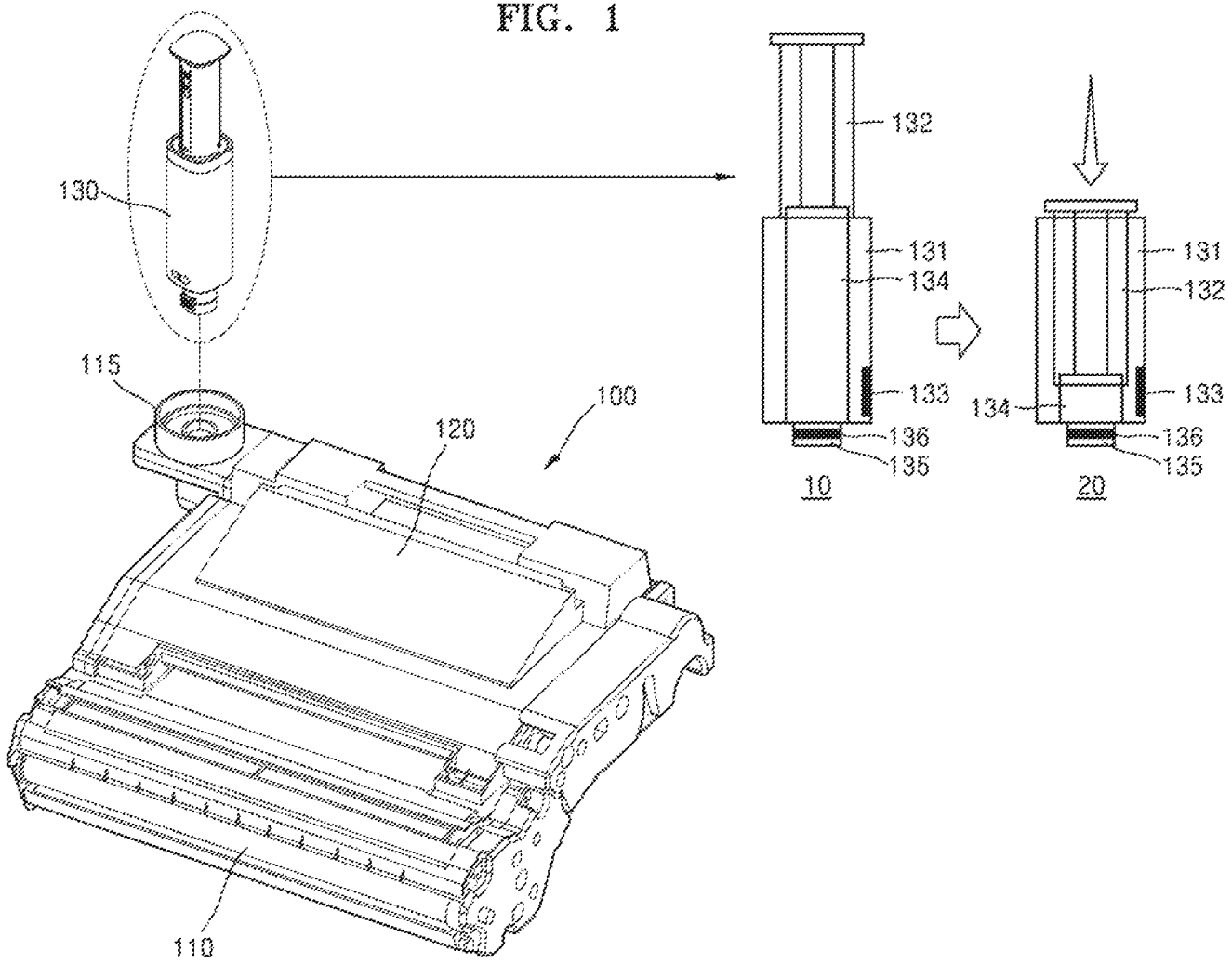
FIG. 1 is a diagram showing a cartridge and a toner reload kit (TRK) in an image forming apparatus, according to an example.
Figure 11:
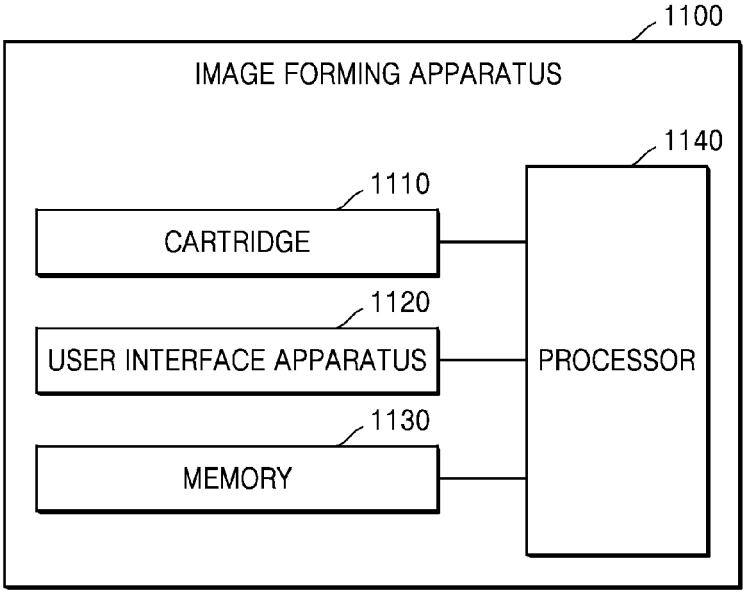
FIG. 11 is a block diagram showing a configuration of an image forming apparatus according to an example.

FIG. 1 is a diagram showing a cartridge 100 and a toner reload kit (TRK) 130 in an image forming apparatus (e.g., an image forming apparatus 1100 as shown in FIG. 11), according to an example.

The cartridge 100 may be mounted on the image forming apparatus 1100 or removed from the image forming apparatus 1100. The cartridge 100 may include a developing device 110 in which a photosensitive drum and a developing roller are installed, a waste toner container (not shown) in which a waste toner removed from the photosensitive drum is contained, and a toner container 120 connected to the developing device 110 and containing toner. The toner container 120 may supply the toner to be used for an image forming job to the developing device 110. When the toner in the toner container 120 is completely exhausted, the toner container 120 may receive toner from the TRK 130.

The cartridge 100 may include a toner charging interface 115 connected to the toner container 120. The toner charging interface 115 may provide a structure for fixing the TRK 130 to be connected to the cartridge 100 and to allow the toner to be supplied from the TRK 130 to the cartridge 100. The cartridge 100 may also be an integral cartridge including the developing device 110, the waste toner container (not shown), the toner container 120, and the toner charging interface 115.

Referring to an image 10 of FIG. 1, the TRK 130 may include a body 131, a plunger 132, and a memory 133. The body 131 may include an internal space 134 in which the toner is contained and a toner discharge port 135 through which the toner is discharged. In addition, the toner discharge port 135 may include a discharge shutter 136 capable of opening and closing the toner discharge port 135. The TRK 130 may include more elements than the above-mentioned elements.

Referring to an image 20 of FIG. 1, the plunger 132 may be inserted into the internal space 134 to be movable in a longitudinal direction of the body 131. The plunger 132 may have a syringe or cylinder shaped loading stand such that the toner in the internal space 134 is discharged through the toner discharge port 135. The discharge shutter 136 may open and close the toner discharge port 135.

For example, the body 131 may be cylindrical. An end of the body 131 may include the toner discharge port 135 through which the toner is discharged and the discharge shutter 136 which opens and closes the toner discharge port 135. The plunger 132 may be inserted into the internal space 134 from an opposite end of the toner discharge port 135 of the body 131. When an activation of the TRK 130 is completed and the TRK 130 is connected to the cartridge 100 such that the TRK 130 supplies the toner to the cartridge 100, the discharge shutter 136 may open the toner discharge port 135. Further, the discharge shutter 136 may include an operation lever capable of operating the toner discharge port 135.

The memory 133 may store identification information of the TRK 130 and information indicating whether a toner refill is completed. When the TRK 130 is mounted on the image forming apparatus 1100, the image forming apparatus 1100 may confirm the information stored in the memory 133 of the TRK 130. For example, the image forming apparatus 1100 may perform the activation of the TRK 130 by confirming the identification information of the TRK 130. The image forming apparatus 1100 may confirm the information indicating whether the toner refill is completed to confirm whether a refill operation of the TRK 130 is possible. Also, when the refill operation of the TRK 130 is completed, the image forming apparatus 1100 may store a toner refill completion record in the memory 133 of the TRK 130. Here, the memory 133 may be a nonvolatile memory 133.

Meanwhile, the TRK 130 may include at least one electrical contact. The at least one electrical contact may change to an on state or an off state according to a state in which the TRK 130 is connected to the image forming apparatus 1100. A resistance of the TRK 130 may vary according to a state of the at least one electrical contact. The image forming apparatus 1100 may obtain a voltage of the TRK 130 based on the resistance of the TRK 130.

The image forming apparatus 1100 may confirm a control state of the TRK 130 and check whether the refill operation of the TRK 130 is normally performed, based on the voltage of the TRK 130. When the refill operation of the TRK 130 is performed abnormally, the image forming apparatus 1100 may perform a subsequent operation such that the refill operation may be normally performed.

Figure 2:
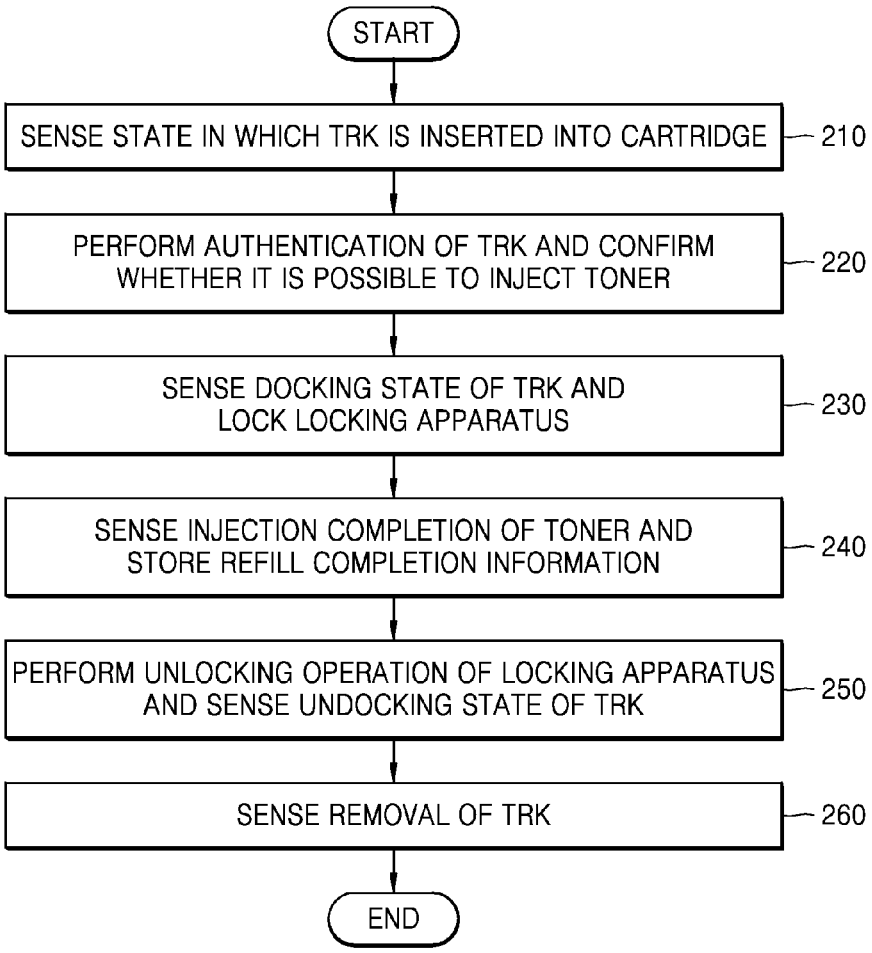
FIG. 2 is a flowchart for explaining a toner refill process performed by an image forming apparatus, according to an example.

FIG. 2 is a flowchart for explaining a toner refill process performed by the image forming apparatus 1100, according to an example.

In operation 210 of the image forming apparatus 1100 in FIG. 2, the image forming apparatus 1100 may sense a state in which the TRK 130 is inserted into a cartridge. For example, a user may insert the TRK 130 into the cartridge through a toner charging interface of the image forming apparatus 1100. The image forming apparatus 1100 may sense the state in which the TRK 130 is inserted into the cartridge through a sensor in the image forming apparatus 1100.

In operation 220 of the image forming apparatus 1100, the image forming apparatus 1100 may perform an authentication of the TRK 130 and may confirm whether it is possible to inject the toner into the cartridge from the TRK 130. For example, the image forming apparatus 1100 may perform the activation of the TRK 130 based on identification information of the TRK 130 stored in a memory within the TRK 130. For example, the identification information may be information about a model number of the TRK 130, a product number, and the like. When the activation of the TRK 130 is completed, the image forming apparatus 1100 may confirm whether a toner refill completion record stored in the memory exists to confirm whether it is possible to inject the toner into the cartridge from the TRK 130.

For example, when the toner refill completion record is stored in the memory of the TRK 130, the image forming apparatus 1100 may display information indicating that it is impossible to use the inserted TRK 130. On the other hand, when the toner refill completion record is not stored in the memory of the TRK 130, the image forming apparatus 1100 may display information for guiding an operation for refilling the toner.

In operation 230 of the image forming apparatus 1100, the image forming apparatus 1100 may sense a docking state of the TRK 130. Then, the image forming apparatus 1100 may perform a locking operation of a locking apparatus in the docking state of the TRK 130.

For example, according to operation 220 of the image forming apparatus 1100, when it is possible to inject the toner into the cartridge from the TRK 130, the image forming apparatus 1100 may perform an unlocking operation of the locking apparatus such that the TRK 130 is in a rotatable state. When the TRK 130 rotates and is in the docking state, the image forming apparatus 1100 may perform the locking operation of the locking apparatus to fix the TRK 130 to the cartridge.

Here, the docking state of the TRK 130 may be a state changed to a state in which the TRK 130 rotates in a state in which the TRK 130 is inserted into the cartridge such that it is possible to inject the toner from a toner discharge port to a toner container. For example, the TRK 130 may be in the state in which when the TRK 130 rotates by 180 degrees in the state in which the TRK 130 is inserted into the cartridge, the toner discharge port and an entrance of the toner container are engaged with each other such that it is possible to inject the toner into the cartridge from the TRK 130. At this time, the image forming apparatus 1100 may perform a locking operation of the locking apparatus to fix the TRK 130. When the locking operation of the locking apparatus is performed, the TRK 130 may not be removed from the cartridge, and a rotation operation is also impossible.

In operation 240 of the image forming apparatus 1100, the image forming apparatus 1100 may sense an injection completion of the toner from the TRK 130 to the cartridge. Then, the image forming apparatus 1100 may store refill completion information of the toner.

For example, when the refill operation of the toner from the TRK 130 to the cartridge is completed, the state of the electrical contact in the TRK 130 may change. The image forming apparatus 1100 may obtain a voltage corresponding to the state of the electrical contact from the TRK 130 and sense the injection completion of the toner.

For example, the image forming apparatus 1100 may update toner remaining amount information of the cartridge. In this case, the image forming apparatus 1100 may display the toner remaining amount information on a user interface apparatus of the image forming apparatus 1100. In addition, the image forming apparatus 1100 may store the refill completion record in the memory in the TRK 130

In operation 250 of the image forming apparatus 1100, the image forming apparatus 1100 may perform an unlocking operation of the locking apparatus. When the unlocking operation of the locking apparatus is performed, the TRK 130 becomes rotatable. The image forming apparatus 1100 may sense an undocking state of the TRK 130 when the TRK 130 rotates and is in the undocking state in which the TRK 130 may be removed from the cartridge.

In operation 260 of the image forming apparatus 1100, when the TRK 130 is removed from the cartridge, the image forming apparatus 1100 may sense a removal of the TRK 130.

Figure 3:
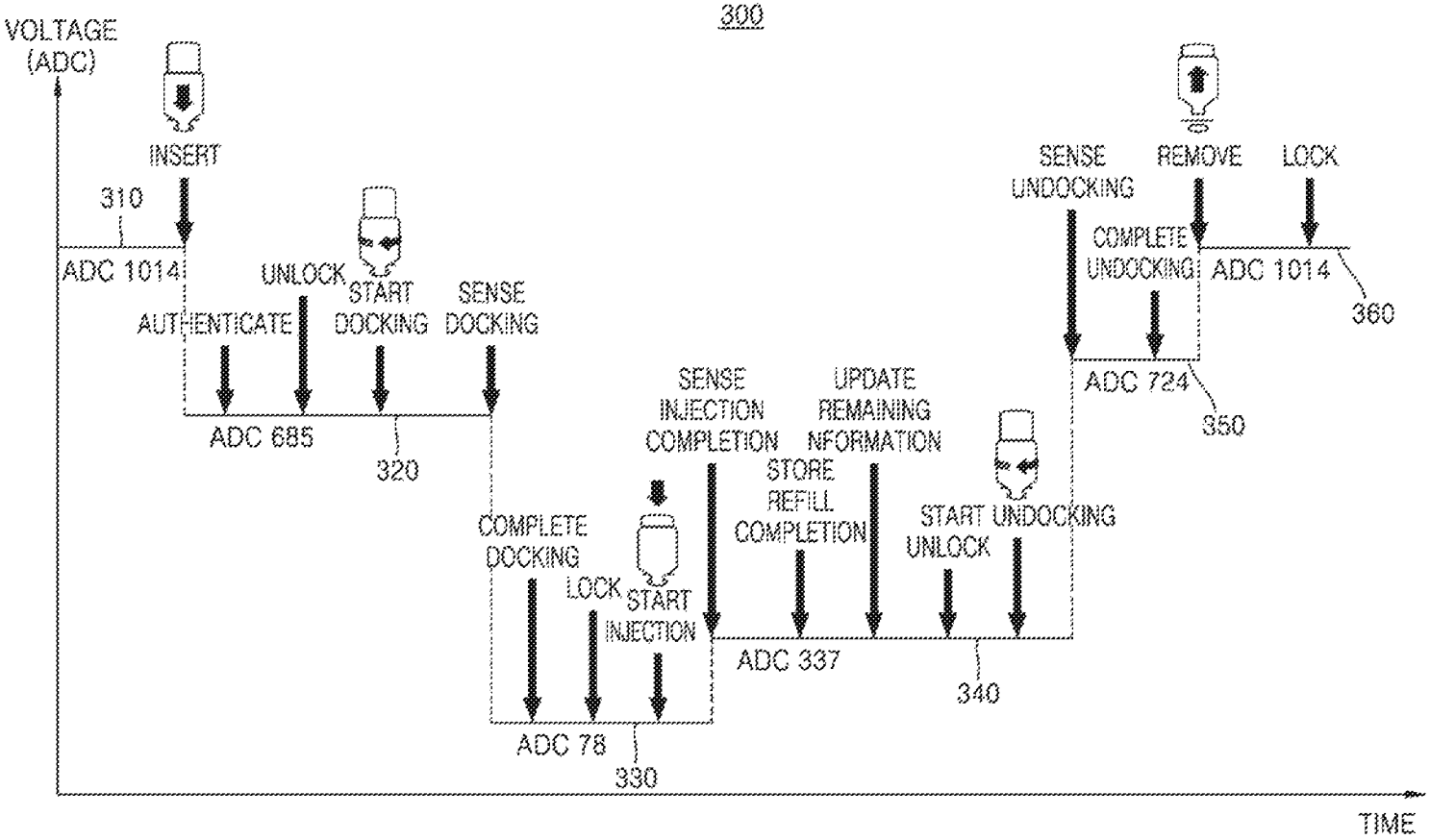
FIG. 3 is a diagram for explaining a voltage of a TRK according to a toner refill process, according to an example.

FIG. 3 is a diagram for explaining a voltage of the TRK 130 according to a toner refill process, according to an example.

The TRK 130 may be mounted to the image forming apparatus 1100 to refill toner into a cartridge in the image forming apparatus 1100. In the toner refill process, a control state of the TRK 130 may include a first state in which the TRK 130 is removed from the image forming apparatus 1100, a second state in which the TRK 130 is inserted into the image forming apparatus 1100, a third state in which the TRK 130 is docked in the cartridge such that the toner may be injected into the cartridge, a fourth state in which the toner is completely injected into the cartridge from the TRK 130, and a fifth state in which the TRK 130 is undocked such that the TRK 130 may be removed from the cartridge.

The TRK 130 may include at least one electrical contact. According to the control state of the TRK 130, the at least one electrical contact may vary to an on state or an off state. That is, a state of the electrical contact is the on state or the off state according to a state of the TRK 130 combined to the image forming apparatus 1100, and a resistance of the TRK 130 changes. Therefore, when the control state of the TRK 130 changes, the voltage of the TRK 130 may change. The control state of the TRK 130 may be sensed as the voltage of the TRK 130. The image forming apparatus 1100 may obtain the voltage indicating the control state of the TRK 130 through a sensor.

The first state of the TRK 130 is a state in which the TRK 130 is removed from the image forming apparatus 1100. That is, the first state is a state before the TRK 130 is inserted into the image forming apparatus 1100. In this case, referring to a graph of FIG. 3, an analog-digital converter (ADC) value 310 of the voltage with respect to the first state of the TRK 130 is 1014. The image forming apparatus 1100 may determine the control state of the TRK 130 as a removal state from the ADC value 310.

The second state of the TRK 130 is a state in which the TRK 130 is inserted into the image forming apparatus 1100. When the TRK 130 is inserted into the cartridge, the image forming apparatus 1100 may perform an authentication of the TRK 130 and may confirm whether a refill operation of the toner is possible. When the refill operation of the toner is possible, the image forming apparatus 1100 may perform the unlocking operation of the locking apparatus such that the TRK 130 is in a rotatable state. In this case, referring to the graph of FIG. 3, an ADC value 320 of the voltage with respect to the second state of the TRK 130 is 685. The ADC value 320 with respect to the second state may be maintained until a docking operation of the TRK 130 is sensed. The state of the electrical contact may change when the docking operation of the TRK 130 is completed, and thus the ADC value 320 with respect to the second state may be maintained even when the docking operation of the TRK 130 starts. The image forming apparatus 1100 may determine the control state of the toner release kit 130 as an insertion state from the ADC value 320.

Referring to the graph of FIG. 3, in the state in which the TRK 130 is inserted, an activation operation of the TRK 130, the unlocking operation of the locking apparatus, and a docking start operation of the TRK 130 may be performed.

The third state of the TRK 130 is a state in which the TRK 130 is docked in the cartridge such that toner may be injected into the cartridge. For example, when the TRK 130 rotates by 180 degrees (for example, rotates by 180 degrees clockwise) in the second state in which the TRK 130 is inserted into the cartridge, the TRK 130 may be in the third state in which a toner discharge port and an entrance of a toner container are engaged with each other such that it is possible to inject the toner into the cartridge from the TRK 130. In this case, referring to the graph of FIG. 3, an ADC value 330 with respect to the third state of the TRK 130 is 78. The ADC value 330 with respect to the third state may be maintained until a state in which an injection of the toner from the TRK 130 into the cartridge is completed is sensed. The state of the electrical contact may change when the injection of the toner is completed, and thus the ADC value 330 with respect to the third state may be maintained even when an injection operation of the toner from the TRK 130 to the cartridge starts. The image forming apparatus 1100 may determine the control state of the TRK 130 as a docking state from the ADC value 330.

Referring to the graph of FIG. 3, in the docking state of the TRK 130, a docking completion operation of the TRK 130, a locking operation of the locking apparatus, and a toner injection starting operation of the TRK 130 may be performed.

The fourth state of the TRK 130 is a state in which an injection of the toner from the TRK 130 to the cartridge is completed. When the injection of the toner is completed, the image forming apparatus 1100 may store a refill completion record in a memory of the TRK 130. Further, the image forming apparatus 1100 may update toner remaining amount information of the cartridge. In addition, the image forming apparatus 1100 may perform the unlocking operation of the locking apparatus such that the TRK 130 may be removed from the cartridge. In this case, referring to the graph of FIG. 3, an ADC value 340 with respect to the fourth state of the TRK 130 is 337. The ADC value 340 with respect to the fourth state may be maintained until an undocking operation of the TRK 130 is sensed. The state of the electrical contact may change when the undocking operation of the TRK 130 is completed, and thus, the ADC value 340 with respect to the fourth state may be maintained even when the undocking operation of the TRK 130 starts. The image forming apparatus 1100 may determine the control state of the TRK 130 as a dispensing state from the ADC value 340.

Referring to the graph of FIG. 3, in the dispensing state of the TRK 130, the injection completion operation of the toner of the TRK 130, an operation of storing the toner refill completion record in the memory of the TRK 130, an operation of updating the toner remaining amount information of a toner amount in a memory of the image forming apparatus 1100, the unlocking operation of the locking apparatus, and an undocking start operation of the TRK 130 may be performed.

The fifth state of the TRK 130 is a state in which the TRK 130 is undocked such that the TRK 130 may be removed from the cartridge. For example, after the injection of the toner is completed, when the TRK 130 rotates by 180 degrees in the third state in which the TRK 130 is docked (for example, rotates by 180 degrees counterclockwise), the TRK 130 may be in the fifth state in which the TRK 130 is undocked such that the TRK 130 may be removed from the cartridge. In this case, referring to the graph of FIG. 3, an ADC value 350 with respect to the fifth state of the TRK 130 is 724. The ADC value 350 with respect to the fifth state may be maintained until the TRK 130 is removed from the cartridge. The image forming apparatus 1100 may determine the control state of the TRK 130 as an undocking state from the ADC value 350.

Referring to the graph of FIG. 3, in the undocking state of the TRK 130, an undocking completion operation of the TRK 130 may be performed.

When the image forming apparatus 1100 senses the state in which the TRK 130 is removed from the image forming apparatus 1100, the state of the TRK 130 is the first state, and an ADC value 360 is 1014. The image forming apparatus 1100 may determine the control state of the TRK 130 as the removal state from the ADC value 360. In the removal state of the TRK 130, an operation of removing the TRK 130 from the image forming apparatus 1100 may be performed.

Figure 4:
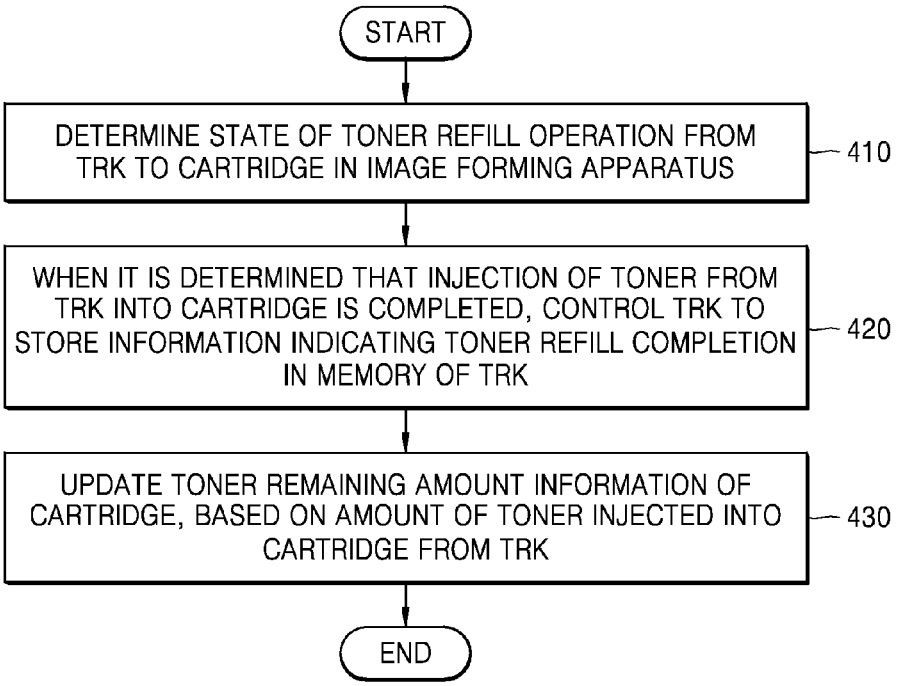
FIG. 4 is a flowchart for explaining an operation method of an image forming apparatus for performing a refill operation of a TRK, according to an example.

FIG. 4 is a flowchart for explaining an operation method of an image forming apparatus for performing a refill operation of the TRK 130, according to an example.

In operation 410 of the image forming apparatus 100 of FIG. 4, the image forming apparatus 1100 may determine a state of a toner refill operation from the TRK 130 to a cartridge in the image forming apparatus 1100. For example, the image forming apparatus 1100 may obtain state information indicating a control state of the TRK 130 that refills toner to the cartridge through a sensor in the image forming apparatus 100.

For example, the image forming apparatus 1100 may obtain a voltage corresponding to a combined state of the TRK 130 and the image forming apparatus 1100. The image forming apparatus 1100 may determine the state of the toner refill operation based on the obtained voltage. For example, the image forming apparatus 1100 may obtain the voltage of the TRK 130 indicating a state that the TRK 130 is combined with the image forming apparatus 1100, through the sensor. The image forming apparatus 1100 may obtain the state information indicating the control state of the TRK 130 based on the voltage.

Here, the voltage may be determined based on a resistance determined according to on state or off state of an electrical contact in the TRK 130, wherein a state of the electrical contact is changed to the on state or the off state of the electrical contact according to the combined state of the TRK 130 and the image forming apparatus 1100.

For example, the refill operation state of the TRK 130 may be determined based on the combined state of the TRK 130 and the image forming apparatus 1100. That is, the refill operation state may indicate the control state of the TRK 130. The refill operation state may include a first state in which the TRK 130 is removed from the image forming apparatus 1100, a second state in which the TRK 130 is inserted into the image forming apparatus 1100, a third state in which the TRK 130 is docked in the cartridge such that the toner may be injected into the cartridge in the second state, a fourth state in which the injection of the toner from the TRK 130 into the cartridge is completed, and a fifth state in which the TRK 130 is undocked such that the TRK 130 may be removed from the cartridge in the third state.

When it is determined in operation 420 of the image forming apparatus 1100 that the injection of the toner from the TRK 130 into the cartridge is completed, the image forming apparatus 1100 may control the TRK 130 to store information indicating a toner refill completion in the memory of the TRK 130.

For example, when the state information of the sensor indicates the state in which the injection of the toner from the TRK 130 to the cartridge is completed, the image forming apparatus 1100 may confirm whether the refill information is stored in the memory of the TRK 130. Here, the refill information may be information indicating the toner refill completion. When the refill information is not stored in the memory of the TRK 130, the image forming apparatus 1100 may control the TRK 130 such that the refill information is stored in the memory of the TRK 130.

For example, when the injection of the toner from the TRK 130 into the cartridge is completed, the image forming apparatus 1100 may determine whether some operations are omitted during the toner refill operation. For example, when the state of the toner refill operation is changed to the state in which the injection of the toner is completed immediately after the on state of the image forming apparatus 1100, the image forming apparatus 1100 may determine that an operation from a toner insertion state to the state in which the injection of the toner is completed is omitted. When it is determined that some operations are omitted, the image forming apparatus 1100 may authenticate the TRK 130. When authentication of the TRK 130 is successful, the image forming apparatus 1100 may store the information indicating the toner refill completion in the memory of the TRK 130.

For example, when the state information indicating the state in which the injection of the toner is completed is obtained while a predetermined operation in a toner refill process is omitted, the image forming apparatus 1100 may determine that the state information is obtained according to an abnormal refill operation of the TRK 130. Here, the predetermined operation in the toner refill process may correspond to a predetermined control state of the TRK 130. The image forming apparatus 1100 may determine whether to perform the authentication of the TRK 130 based on the omitted predetermined operation. When the authentication of the TRK 130 is completed, the image forming apparatus 1100 may store the refill information in the memory of the TRK 130.

For example, when the state information indicating the state in which the injection of the toner is completed is obtained immediately after the on state of the image forming apparatus 1100, the image forming apparatus 1100 may determine that the state information is obtained according to the abnormal refill operation of the TRK 130. An operation of the image forming apparatus 110 performed by obtaining the state information indicating the state in which the injection of the toner is completed immediately after the on state of the image forming apparatus 1100 will be described in detail with reference to FIGS. 7 to 8.

For example, when the state in which the TRK 130 is inserted into the image forming apparatus 1100 is changed to the state in which the injection of the toner from the TRK 130 to the cartridge is completed, the image forming apparatus 1100 may determine that an operation of docking the TRK 130 to the cartridge is omitted. The image forming apparatus 1100 may confirm whether the information indicating the toner refill completion is stored in the memory of the TRK 130. When the information indicating the toner refill completion is not stored in the memory of the TRK 130 as a result of confirmation, the image forming apparatus 1100 may store the information indicating the toner refill completion in the memory of the TRK 130.

For example, the image forming apparatus 1100 may detect a change from first state information indicating the state in which the TRK 130 is inserted into the image forming apparatus 1100 to second state information indicating the state in which the injection of the toner from the TRK 130 to the cartridge is completed. The image forming apparatus 1100 may determine that the change from the first state information to the second state information is obtained according to the abnormal refill operation of the TRK 130. An operation of the image forming apparatus 110 performed by detecting the change from the first state information to the second state information will be described in detail in FIGS. 9 to 10.

For example, the image forming apparatus 1100 may confirm whether the state in which the TRK 130 is inserted into the image forming apparatus 1100 is included in a predetermined control state of the TRK 130 corresponding to the omitted predetermined operation. When the state in which the TRK 130 is inserted into the image forming apparatus 1100 is included in the predetermined control state of the TRK 130 corresponding to the omitted predetermined operation, the image forming apparatus 1100 may perform authentication of the TRK 130.

In operation 430 of the image forming apparatus 1100, the image forming apparatus 1100 may update toner remaining amount information of the cartridge, based on an amount of toner injected into the cartridge from the TRK 130. The image forming apparatus 1100 may display the toner remaining amount information through a user interface apparatus in the image forming apparatus 1100.

For example, when the refill information indicating the state in which the injection of the toner is completed is stored in the memory of the TRK 130, the image forming apparatus 1100 may unlock a locking apparatus in the image forming apparatus 1000 such that the TRK 130 may be removed from the cartridge.

Figure 5A:
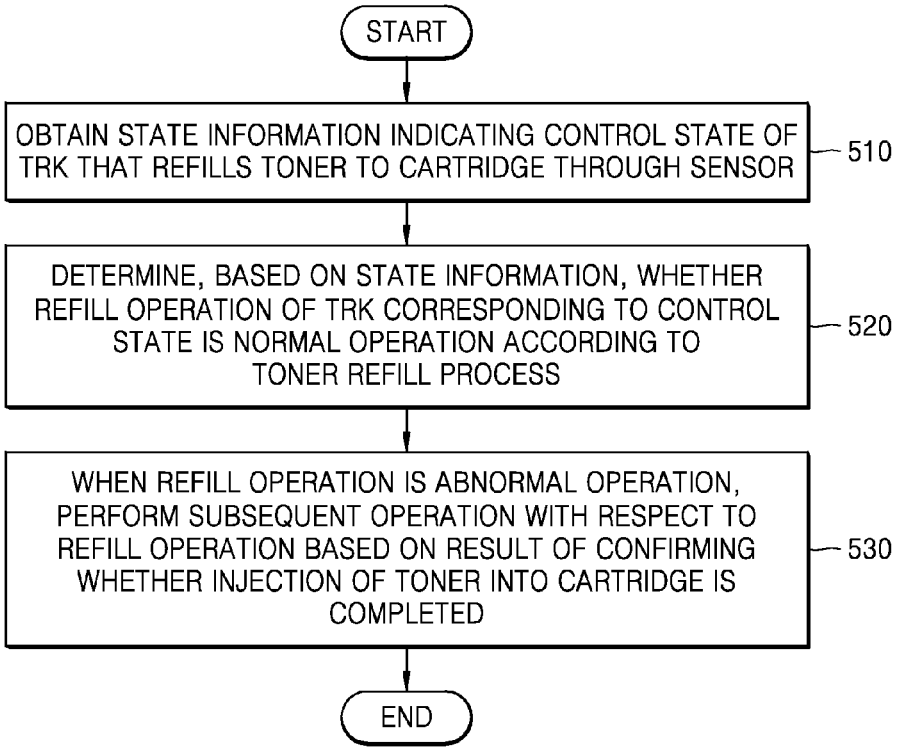
FIGS. 5A and 5B are flowcharts for explaining an operation method of an image forming apparatus for performing a refill operation of a TRK, according to an example.

FIG. 5A is a flowchart for explaining an operation method of an image forming apparatus for performing a refill operation of the TRK 130, according to an example.

In operation 510 of the image forming apparatus 1100 of FIG. 5A, the image forming apparatus 1100 may obtain state information indicating a control state of the TRK 130 that refills toner to a cartridge through a sensor in the image forming apparatus 1100.

In operation 520 of the image forming apparatus 1100, the image forming apparatus 1100 may determine, based on the state information, whether a refill operation of the TRK 130 corresponding to the control state is a normal operation according to a toner refill process.

For example, the image forming apparatus 1100 may determine, based on the toner refill process and previous state information of the sensor, whether a change from the previous state information to the state information indicating the control state is a normal change according to the toner refill process. When the change from the previous state information to the state information is an abnormal change, the image forming apparatus 1100 may determine a refill operation as an abnormal operation. The operation 520 of the image forming apparatus 1100 will be described in detail in operations 525-1 and 525-2 of the image forming apparatus 1100 in FIG. 5B.

In operation 530 of the image forming apparatus 1100, when the refill operation is the abnormal operation, the image forming apparatus 1100 may perform a subsequent operation with respect to the refill operation based on a result of confirming whether an injection of the toner into the cartridge is completed.

For example, based on a history of the state information of the sensor and the result of confirming that the injection of the toner into the cartridge is completed, the image forming apparatus 1100 may determine at least one operation to be omitted in the toner refill process and at least one subsequent operation to perform in the control state such that the toner refill process may be completed. The determining at least one operation to be omitted in the toner refill process and at least one subsequent operation to perform in the control state such that the toner refill process may be completed will be described in detail in operation 535 of the image forming apparatus 1100 in FIG. 5B.

For example, when the injection of the toner into the cartridge is completed, the image forming apparatus 1100 may update toner remaining amount information of the cartridge. The image forming apparatus 1100 may display the updated toner remaining amount information through a user interface apparatus of the image forming apparatus 1100. Therefore, the image forming apparatus 1100 may correctly reflect and display the remaining toner amount information of the cartridge.

As another example, when the injection of toner into the cartridge is not completed, the image forming apparatus 1100 may guide the toner in the TRK 130 to be injected into the cartridge.

As another example, when the injection of the toner into the cartridge is completed, the image forming apparatus 1100 may control the TRK 130 to store a refill completion record in a memory in the completely authenticated TRK 130. In this case, the image forming apparatus 1100 may perform re-authentication of the TRK 130 to correctly record the completion of the toner injection into the memory of the TRK 130. In addition, the image forming apparatus 1100 may unlock a locking apparatus in the image forming apparatus 1100 such that the TRK 130 may be removed from the cartridge.

Figure 5B:
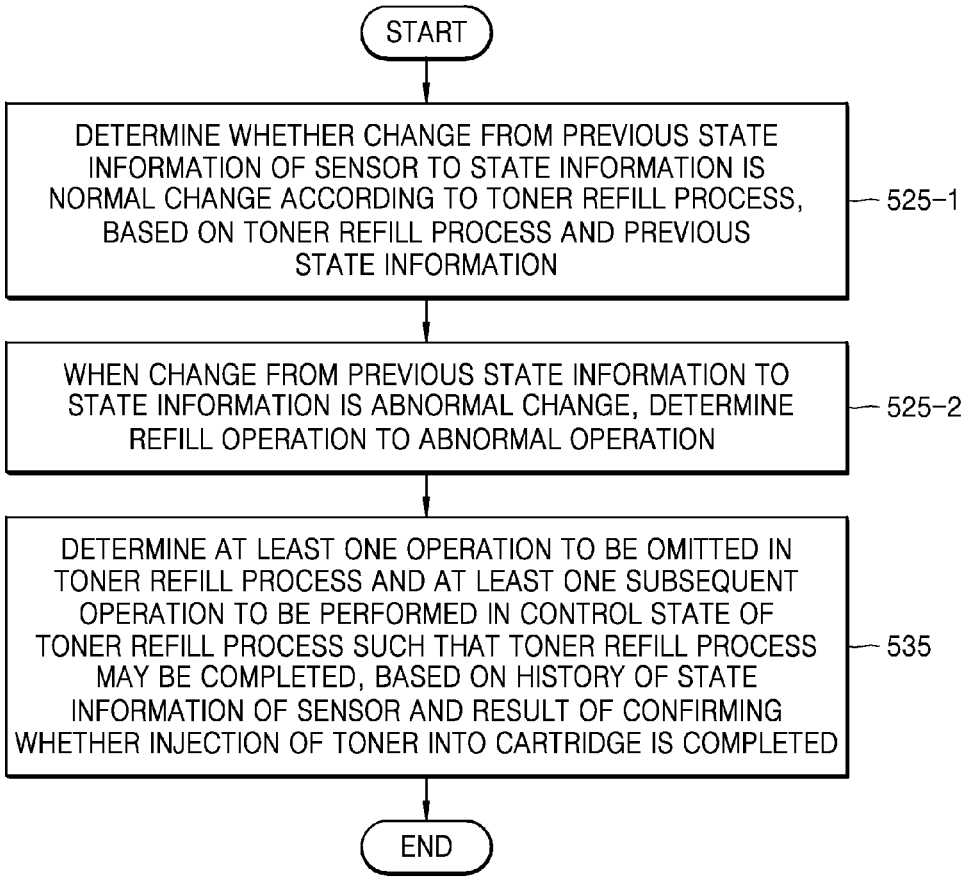

FIG. 5B is a flowchart for explaining an operation method of the image forming apparatus 1100 for performing a refill operation of the TRK 130, according to an example.

In operation 525-1 of the image forming apparatus 1100 in FIG. 5B, the image forming apparatus 1100 may determine whether a change from previous state information of a sensor to state information is a normal change according to a toner refill process, based on the toner refill process and the previous state information. Here, the state information may be current state information indicating a current control state of the TRK 130. The image forming apparatus 1100 may confirm whether there is an omitted operation based on the toner refill process and a state information history of the sensor.

For example, when the previous state information of the sensor indicates a state in which power of the image forming apparatus 1100 is off and current state information of the sensor indicates a state in which an injection of toner into a cartridge is completed immediately after a state in which the power of the image forming apparatus 1100 is on, the image forming apparatus 1100 may determine that an operation to be performed in an insertion state or a docking state of the TRK 130 is omitted and determine that a change of the state information of the sensor is an abnormal change.

As another example, when the previous state information of the sensor indicates that the control state of the TRK 130 indicates the insertion state and the current state information of the sensor indicates the state in which the injection of the toner into the cartridge is completed, the image forming apparatus 1100 may determine that an operation to be performed in the docking state of the TRK 130 is omitted, and determine the change of the state information of the sensor as the abnormal change.

In operation 525-2 of the image forming apparatus 1100, when the change from the previous state information to the state information is the abnormal change, the image forming apparatus 1100 may change the refill operation to an abnormal operation.

In operation 535 of the image forming apparatus 1100, the image forming apparatus 1100 may determine at least one operation to be omitted in the toner refill process and at least one subsequent operation to be performed in the control state of the toner refill process such that the toner refill process may be completed, based on a history of the state information of the sensor and a result of confirming whether the injection of the toner into the cartridge is completed.

For example, when the image forming apparatus 1100 senses through the sensor that the power changes from an off state to an on state and the control state of the TRK 130 is changed to a dispensing state immediately after the on state, the image forming apparatus 1100 may omit an operation to be performed in the insertion state and the docking state of the TRK 130 and may perform an operation to be performed in the dispensing state. Here, the operation to be performed in the dispensing state may include an existing operation to be performed in the dispensing state when the toner refill process is normally performed, and a complementary operation to be performed in the dispensing state by performing the toner refill process abnormally. For example, the supplementary operation may be an operation to perform re-authentication of the TRK 130. Then, the image forming apparatus 1100 may perform an operation to be performed in an undocking state.

As another example, when it is sensed that the control state of the TRK 130 is changed from the insertion state to the dispensing state through the sensor, the image forming apparatus 1100 may omit an operation to be performed in the docking state of the TRK 130 and may perform the operation to be performed in the dispensing state. Then, the image forming apparatus 1100 may perform the operation to be performed in the undocking state.

Figure 6:
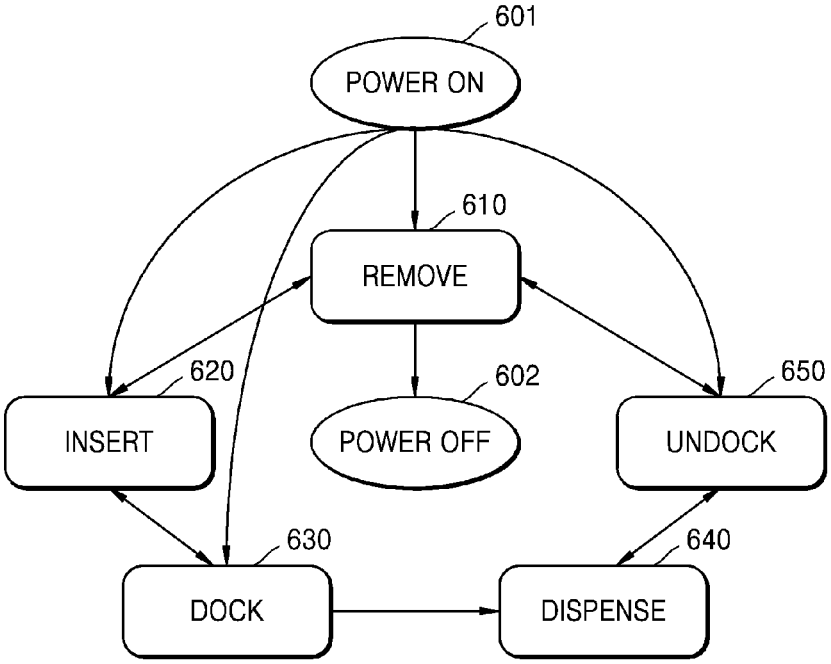
FIG. 6 is a diagram for explaining a control state of a TRK obtained from a sensor, according to an example.

FIG. 6 is a diagram for explaining a control state of the TRK 130 obtained from a sensor, according to an example.

As described in FIG. 3, the control state of the TRK 130 may be classified into a removal state 610 in which the TRK 130 is removed from the image forming apparatus 1100, an insertion state 620 in which the TRK 130 is inserted into the image forming apparatus 1100, a docking state 630 in which the TRK 130 is docked in a cartridge such that toner may be injected into the cartridge, a dispensing state 640 in which an injection of the toner into the cartridge is completed and an undocking state 650 in which the TRK 130 is undocked such that the TRK 130 may be removed from the cartridge.

When the control state of the TRK 130 is changed, a voltage obtained from the sensor may also change. The image forming apparatus 1100 may determine, based on the voltage, whether a refill operation corresponding to the control state of the TRK 130 is a normal operation according to a toner refill process. When the toner refill process is normally performed, the control state of the TRK 130 may change in an order of the removal state 610, the insertion state 620, the docking state 630, the dispensing state 640, the undocking state 650, and the removal state 610.

For example, the image forming apparatus 1100 may determine, based on the toner refill process and previous state information of the sensor, whether a change from the previous state information to current state information is a normal change according to the toner refill process.

For example, according to the toner refill process, a change from the removal state 610 to the insertion state 620, a change from the insertion state 620 to the removal state 610, a change from the insertion state 620 to the docking state 630, a change from the docking state 630 to the insertion state 620, a change from the docking state 630 to the dispensing state 640, a change from the dispensing state 640 to the undocking state 650, a change from the undocking state 650 to the dispensing state 640, a change from the undocking state 650 to the removal state 610, and a change from the removal state 610 to the undocking state 650 is a change from a preceding state to a following state that is an immediately next state, or a change from the following state to the preceding state that is an immediately previous state, and thus, the image forming apparatus 1100 may determine the change as a normal change according to the toner refill process.

For example, during a refill operation of the TRK 130 corresponding to the insertion state 620, the docking state 630, and the undocking state 650, because the image forming apparatus 1100 does not store whether a refill of toner is completed, a change from a power-on state 601 of the image forming apparatus 1100 to the insertion state 620, a change from a power-on state 601 to the docking state 630, and a change from the power-on state 601 to the undocking state 650 may be determined as a normal change according to the toner refill process.

Figure 7:
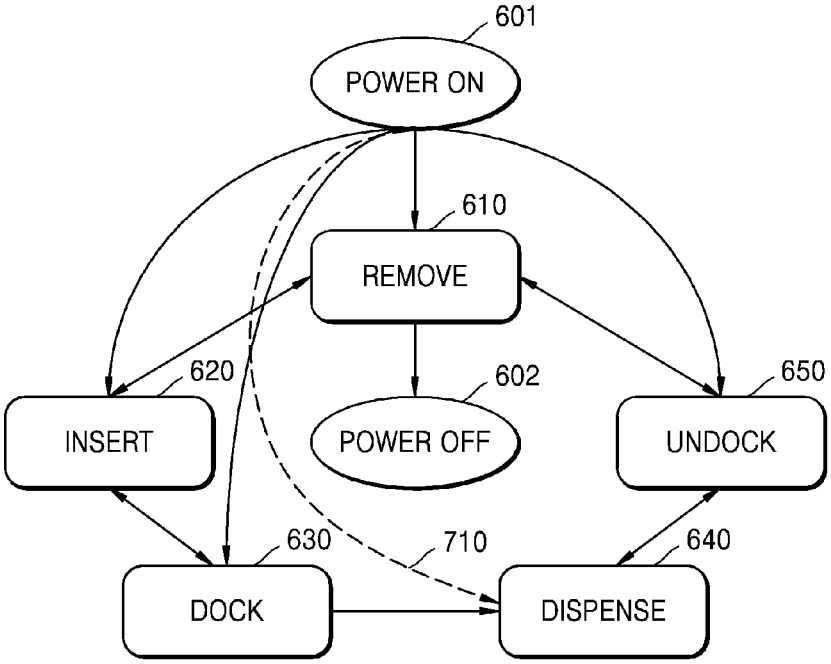
FIG. 7 is a diagram for explaining an abnormal operation of a TRK, according to an example.

FIG. 7 is a diagram for explaining an abnormal operation of the TRK 130, according to an example.

Referring to FIG. 7, immediately after the image forming apparatus 1100 is changed from a power-off state 602 to the power-on state 601, the image forming apparatus 1100 may obtain state information indicating that a control state of the TRK 130 is the dispensing state 640 from a sensor. When the control state of the TRK 130 is sensed as the dispensing state 640 immediately after the image forming apparatus 1100 is in the state 601 in which power is on, an ADC value with respect to the dispensing state 640 may be a value having a predetermined size. That is, the sensor may sense a change 710 of the TRK 130 to the dispensing state 640 immediately after the image forming apparatus 1100 is in the state 601 in which power is on.

For example, when an injection of toner from the TRK 130 to a cartridge is completed in the power-off state 602 of the image forming apparatus 1100 and the image forming apparatus 1100 is in the state 601 in which power is on, the sensor may recognize a change of a state as the change 710 to the dispensing state 640 immediately after the power-on state 601 of the image forming apparatus 1100.

As another example, when the TRK 130 is controlled to the docking state 630 before the image forming apparatus 1100 is in the state 602 in which power is off, and the injection of the toner into the cartridge from the TRK 130 is completed in the power-off state 602, and the image forming apparatus 1100 is in the state 601 in which power is on, the sensor may recognize a change of a state as the change 710 to the dispensing state 640 immediately after the power-on state 601 of the image forming apparatus 1100.

As another example, although the injection of the toner into the cartridge from the TRK 130 is completed before the image forming apparatus 1100 is in the state 602 in which power is off, power is off in a state in which a refill completion of the toner is not stored and then the image forming apparatus 1100 is in the state 601 in which power is on, the sensor may recognize a change of a state as the change 710 to the dispensing state 640 immediately after the image forming apparatus 1100 is in the state 601 in which power is on.

That is, a case where the state is sensed as the dispensing state 640 immediately after the image forming apparatus 1100 is in the state 601 in which power is on may include a case where although the injection of the toner into the cartridge from the TRK 130 is completed, the image forming apparatus 1100 is in the state 602 in which power is off, a case where toner remaining amount information of the cartridge is not updated due to an abnormality of the sensor, a case where because locking of a locking apparatus is maintained, the TRK 130 is not removed from the image forming apparatus 1100, etc.

When the control state of the TRK 130 is sensed as the dispensing state 640 immediately after the image forming apparatus 1100 is in the state 601 in which power is on, the state may be a state in which the injection of the toner into the cartridge from the TRK 130 is completed, and refill completion information of the toner is not stored in the image forming apparatus 1100 or in a memory in the TRK 130. In this case, an amount of toner actually remaining in the TRK 130 and an amount of toner detected from the information stored in the memory of the TRK 130 may be inconsistent.

That is, when the control state of the TRK 130 is sensed as the dispensing state 640 immediately after the image forming apparatus 1100 is in the state 601 in which power is on, because the amount of toner actually remaining in the TRK 130 and the amount of toner detected from the information stored in the memory of the TRK 130 are inconsistent, the image forming apparatus 1100 may determine the change 710 to the dispensing state 640 immediately after the image forming apparatus 1100 is in the state 601 in which power is on as an abnormal change and determine a refill operation of the TRK 130 as an abnormal operation. The image forming apparatus 1100 may determine that the abnormal operation is performed before the state 601 in which power is on.

Figure 8:
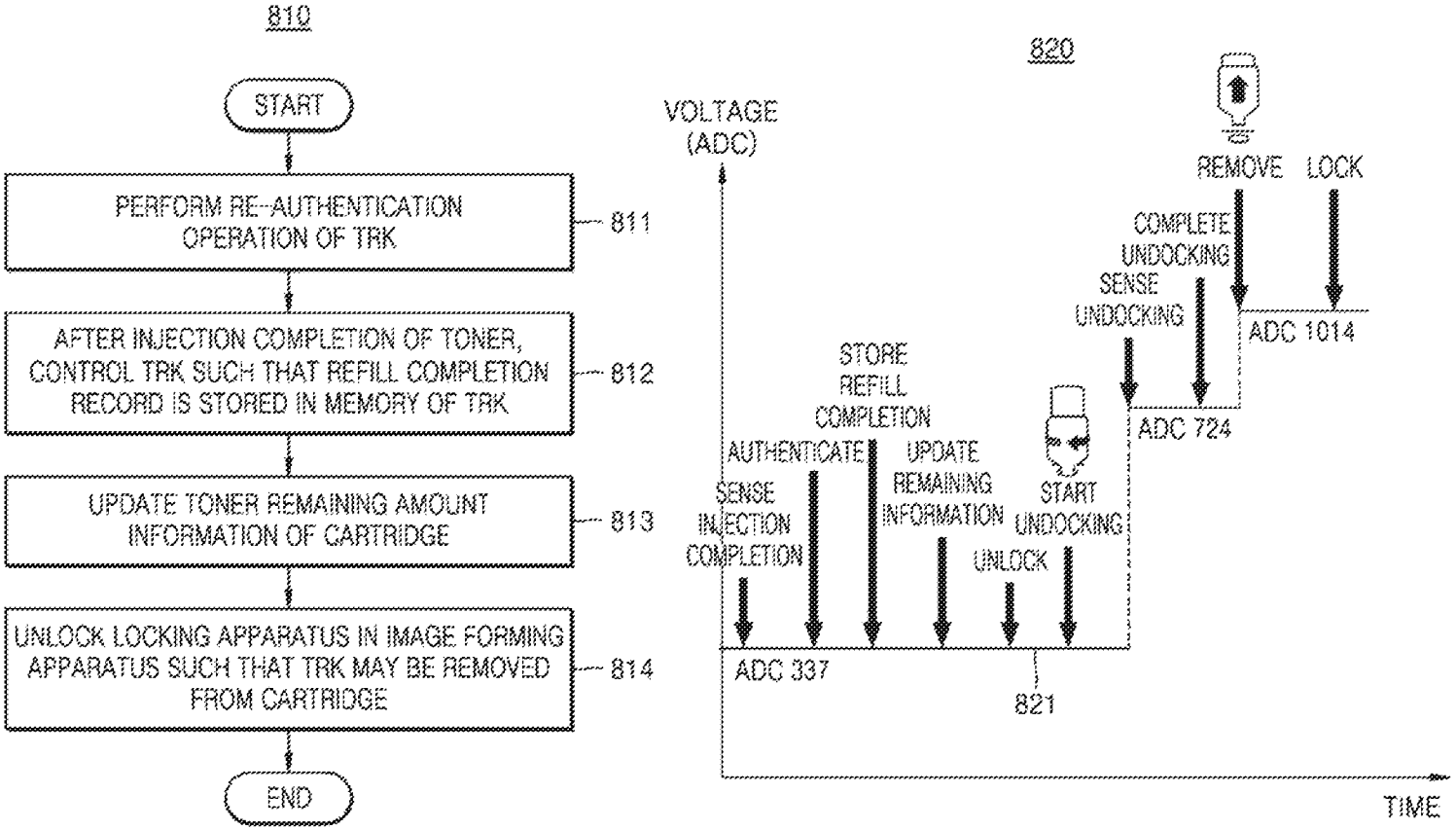
FIG. 8 is a flowchart for explaining a method of performing subsequent operations with respect to an abnormal operation of a TRK detected in FIG. 7, according to an example.

FIG. 8 is a flowchart for explaining a method of performing subsequent operations with respect to an abnormal operation of the TRK 130 detected in FIG. 7, according to an example.

When the image forming apparatus 1100 changes from a power-off state to a power-on state and a control state of the TRK 130 is changed to a dispensing state immediately after the power-on state, an ADC value obtained from a sensor may be 337, which is an ADC value 821 with respect to the dispensing state, according to a graph 820 of FIG. 8. The image forming apparatus 1100 may obtain state information indicating the control state of the TRK 130 based on the ADC value 821. That is, the image forming apparatus 1100 may confirm that the TRK 130 is detected as the dispensing state immediately after the image forming apparatus 1100 changes from the power-off state to the power-on state. When the control state of the TRK 130 is detected as the dispensing state immediately after the power-on state of the image forming apparatus 1100, the image forming apparatus 1100 may determine a refill operation by the TRK 130 as the abnormal operation.

According to the flowchart 810 of FIG. 8, the image forming apparatus 1100 may perform subsequent operations with respect to the abnormal refill operation.

In operation 811 of the image forming apparatus 1100, the image forming apparatus 1100 may perform a re-authentication operation of the TRK 130.

In operation 812 of the image forming apparatus 1100, after an injection completion of toner, the image forming apparatus 1100 may control the TRK 130 such that a refill completion record is stored in a memory of the TRK 130.

In operation 813 of the image forming apparatus 1100, the image forming apparatus 1100 may update toner remaining amount information of the cartridge.

In operation 814 of the image forming apparatus 1100, the image forming apparatus 1100 may unlock a locking apparatus in the image forming apparatus 1100 such that the TRK 130 may be removed from the cartridge.

Operations 811 to 814 may be performed by the image forming apparatus 1100 in the abnormal refill operation such that the image forming apparatus 1100 may update the toner remaining amount information of the cartridge, store a toner refill completion record in a memory of the TRK 130, and remove the TRK 130 from the image forming apparatus 1100.

That is, as shown in a graph 820 of FIG. 8, the image forming apparatus 1100 may omit an operation that needs to be performed in an insertion state and a docking state of the TRK 130 and perform an operation that needs to be performed in a dispensing state. Then, the image forming apparatus 1100 may perform an operation that needs to be performed in an undocking state.

Figure 9:
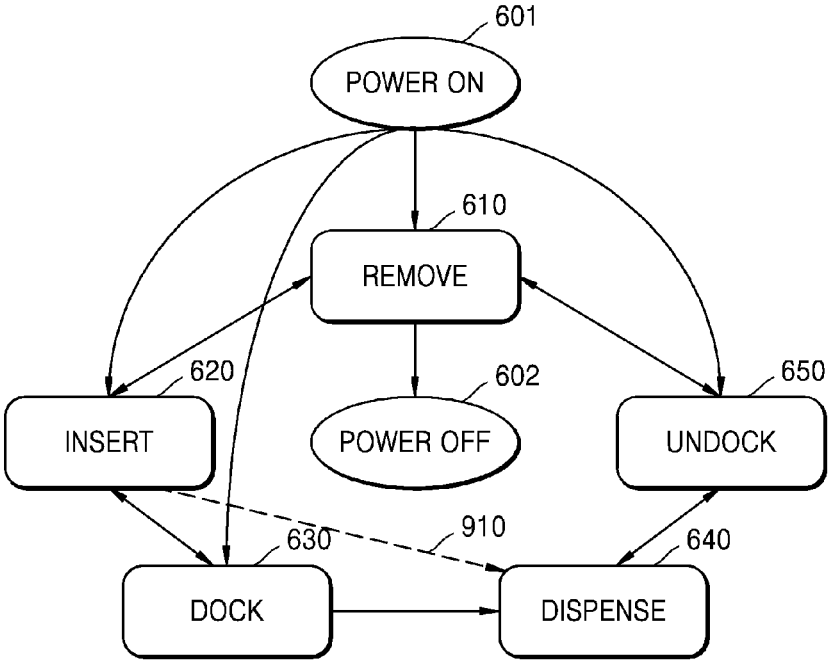
FIG. 9 is a diagram for explaining an abnormal operation of a TRK, according to another example.

FIG. 9 is a diagram for explaining an abnormal operation of the TRK 130, according to another example.

Referring to FIG. 9, a sensor may sense a change 910 of a control state of the TRK 130 from the insertion state 620 to the dispensing state 640.

For example, when the TRK 130 is temporarily separated from the image forming apparatus 1100 during an injection of toner from the TRK 130 to a cartridge, refill completion information of the toner is not stored in the image forming apparatus 1100 or in a memory of the TRK 130 and is combined to the image forming apparatus 1100 again, the sensor may sense the change 910 from the insertion state 620 to the dispensing state 640.

As another example, when a defect in an electrical contact corresponding to the dispensing state 640 of the TRK 130 occurs during a manufacturing process and a distribution process of the TRK 130, the sensor may sense the change 910 from the insertion state 620 to the dispensing state 640.

When a toner refill process is normally performed, the control state of the TRK 130 may be changed in an order of the removal state 610, the insertion state 620, the docking state 630, the dispensing state 640, the undocking state 650, and the removal state 610. However, when the control state of the TRK 130 is sensed as the dispensing state 640 from the insertion state 620, the image forming apparatus 1100 may determine that the docking state 630 of the TRK 130 is omitted. Also, because the control state of the TRK 130 is not sequentially changed according to the toner refill process, even though the control state of the TRK 130 is sensed as the dispensing state 640, the control state may be a state in which the injection of the toner into the cartridge from the TRK 130 is completed, and refill completion information of the toner is not stored in the image forming apparatus 1100 or in a memory in the TRK 130. Therefore, an amount of toner actually remaining in the TRK 130 and an amount of toner detected from the information stored in the memory of the TRK 130 may be inconsistent.

That is, when a change of the control state of the TRK 130 from the insertion state 620 to the dispensed state 640 is sensed, the image forming apparatus 1100 may determine a change 910 to the dispensing state 640 from the insertion state 620 as an abnormal change and determine a refill operation of the TRK 130 as an abnormal operation.

Figure 10:
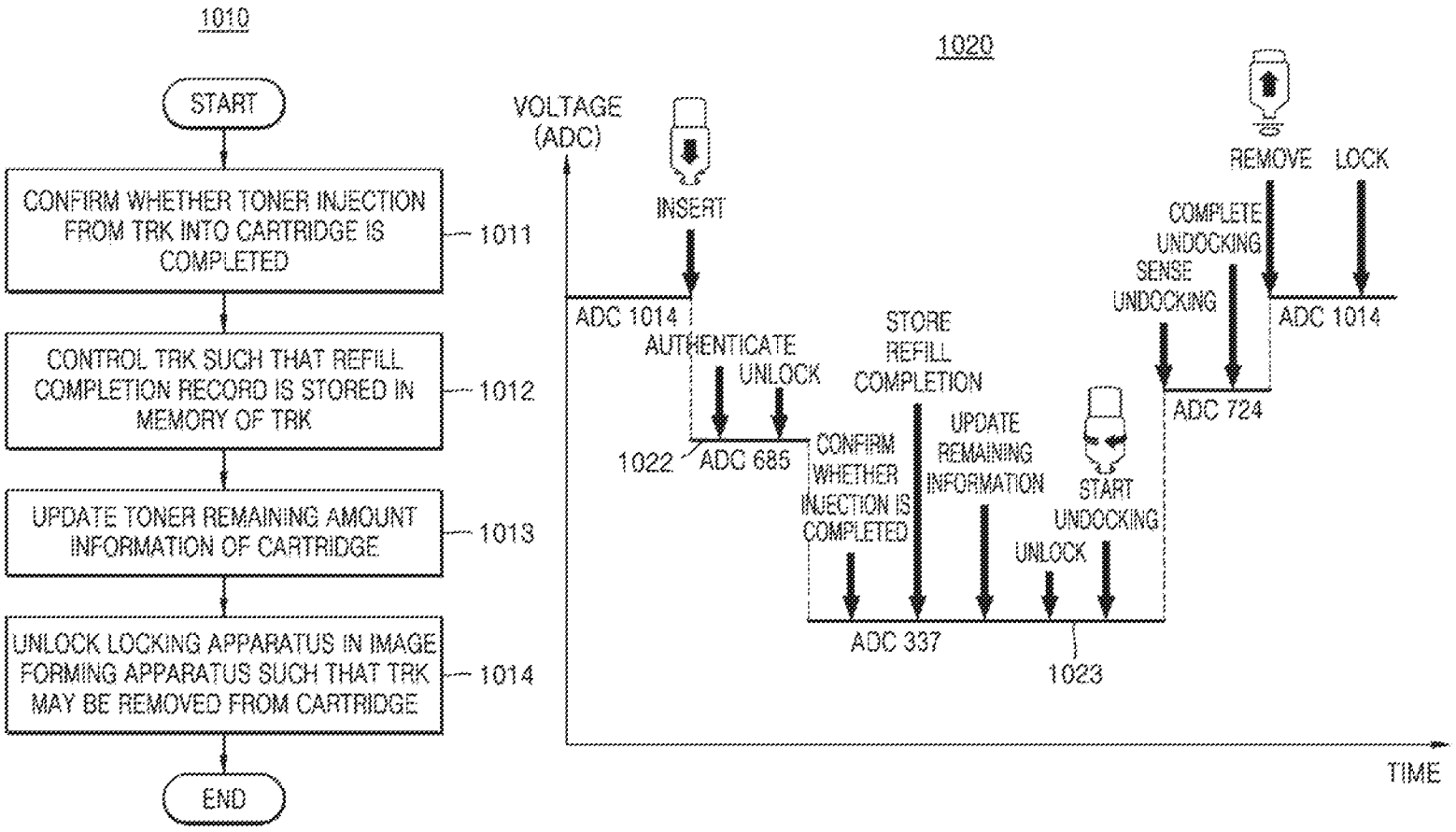
FIG. 10 is a flowchart for explaining a method of performing subsequent operations with respect to an abnormal operation of a TRK detected in FIG. 9, according to an example.

FIG. 10 is a flowchart for explaining a method of performing subsequent operations with respect to an abnormal operation of the TRK 130 detected in FIG. 9, according to an example.

When a control state of the TRK 130 is changed from an insertion state to a dispensing state, according to a graph 1020 of FIG. 10, an ADC value obtained from a sensor may be changed from 685, which is an ADC value 1022 with respect to the insertion state to 337, which is an ADC value 1023 with respect to the dispensing state. The image forming apparatus 1100 may obtain state information indicating the control state of the TRK 130 based on the obtained ADC value. That is, the image forming apparatus 1100 may confirm that the control state of the TRK 130 is changed from the insertion state to the dispensing state. When a change of the control state of the TRK 130 from the insertion state to the dispensing state is detected, the image forming apparatus 1100 may determine a refill operation by the TRK 130 as the abnormal operation.

According to a flowchart 1010 of FIG. 10, the image forming apparatus 1100 may perform subsequent operations with respect to the abnormal refill operation.

In operation 1011 of the image forming apparatus 1100, the image forming apparatus 1100 may confirm whether a toner injection from the TRK 130 into a cartridge is completed. When the toner injection is not completed, the image forming apparatus 1100 may display guide information guiding the toner injection. When the toner injection is completed, the image forming apparatus 1100 may perform operation 1012.

In operation 1012 of the image forming apparatus 1100, the image forming apparatus 1100 may control the TRK 130 such that a refill completion record is stored in a memory of the TRK 130.

In operation 1013 of the image forming apparatus 1100, the image forming apparatus 1100 may update toner remaining amount information of the cartridge.

In operation 1014 of the image forming apparatus 1100, the image forming apparatus 1100 may unlock a locking apparatus in the image forming apparatus 1100 such that the TRK 130 may be removed from the cartridge.

That is, as shown in a graph 1020 of FIG. 10, the image forming apparatus 1100 may omit an operation that needs to be performed in a docking state of the TRK 130, and perform an operation that needs to be performed in the dispensing state. Then, the image forming apparatus 1100 may perform an operation that needs to be performed in an undocking state.

FIG. 11 is a block diagram showing a configuration of the image forming apparatus 1100 according to an example.

The image forming apparatus 1100 shown in FIG. 11 may include a cartridge 1110, a user interface apparatus 1120, a memory 1130, and a processor 1140. However, the illustrated components are not indispensable elements. The image forming apparatus 1100 may be implemented by using more or less elements than those illustrated in FIG. 11, and the image forming apparatus 1100 may be implemented by fewer components. Hereinafter, the elements will be described. On the other hand, the cartridge 1110 shown in FIG. 11 may correspond to the cartridge 100 described in FIG. 1.

The cartridge 1110 may be mounted on the image forming apparatus 1100 or removed from the image forming apparatus 1100. The cartridge 1110 may include a developing device in which a photosensitive drum and a developing roller are installed, a waste toner container in which a waste toner removed from the photosensitive drum is contained, and a toner container connected to the developing device and containing toner. The toner container may supply the toner to be used for an image forming job to the developing device. When the toner in the toner container is completely exhausted, the toner container may receive toner from a TRK. In addition, the cartridge 1110 may include a toner charging interface that allows toner to be supplied to the cartridge 1100 to which the TRK is connected.

The user interface apparatus 1120 may include an input unit for receiving an input for controlling an operation of the image forming apparatus 1100 from a user, etc., and an output unit for displaying information about a result of the operation of the image forming apparatus 1100 or a state of the image forming apparatus 1100, etc. For example, the user interface apparatus 1120 may include an operation panel for receiving a user input, a display panel for displaying a screen, and the like.

For example, the input unit may include, in an example, devices capable of receiving various types of user input, such as a keyboard, a physical button, a touch screen, a camera or a microphone. Further, the output unit may include, in an example, a display panel or a speaker. However, the disclosure is not limited thereto, and the user interface apparatus 1120 may include various devices supporting input/output.

The user interface apparatus 1120 may display toner remaining amount information of an amount of toner charged in the cartridge 1110. For example, the processor 1140 may calculate the amount of toner remaining in the cartridge 1110 in real time. The user interface apparatus 1120 may display the toner remaining amount information of the cartridge 1110 in real time. As another example, the processor 1140 may update the toner remaining amount information of the cartridge 1110 when the toner is refilled to the cartridge 1110. The user interface apparatus 1120 may display the updated toner remaining amount information of the cartridge 1110. In addition, the user interface apparatus 1120 may display guide information guiding a method of operating the TRK.

The memory 1130 may store programs, data, or files related to the image forming apparatus 1100. The processor 1140 may execute the programs stored in the memory 1130, read the data or the files stored in the memory 1130, or store new files in the memory 1130. The memory 1130 may store program instructions, data files, data structures, etc., alone or in combination. The memory 1130 may store instructions executable by the processor 1140.

The memory 1130 may store state information obtained from a sensor. Further, the memory 1130 may store the toner remaining amount information of the cartridge 1110. In addition, the memory 1130 may store a program for controlling the operation of the image forming apparatus 1100 such that a refill operation may be normally performed when the refill operation by the TRK is detected as an abnormal operation.

The processor 1140 may control the overall operation of the image forming apparatus 1100, and may include at least one processor such as a CPU or the like. The processor 1140 may include at least one specialized processor corresponding to each function or may be an integrated processor.

The processor 1140 may obtain state information indicating a control state of the TRK in which the toner is refilled to the cartridge 1110 through the sensor in the image forming apparatus 1100.

For example, the processor 1140 may obtain a voltage of the TRK indicating a state in which the TRK is combined to the image forming apparatus 1100 through the sensor. The processor 1140 may obtain state information indicating the control state of the TRK based on the voltage.

Here, the voltage may be determined based on a resistance that varies to an on state or an off state of an electrical contact of the TRK, according to the state in which the TRK is combined to the image forming apparatus 1100.

For example, the control state of the TRK may include a first state in which the TRK is removed from the image forming apparatus 1100, a second state in which the TRK is inserted into the image forming apparatus 1100, a third state in which the TRK is docked in the cartridge 1110 such that the toner may be injected into the cartridge in the second state, a fourth state in which the injection of the toner from the TRK into the cartridge 1110 is completed, and a fifth state in which the TRK is undocked such that the TRK may be removed from the cartridge 1110 in the third state.

When state information of the sensor indicates a state in which the injection of the toner from the TRK to the cartridge 1110 is completed, the processor 1140 may control the TRK to store refill information indicating a toner refill completion in the memory of the TRK.

For example, when the state information of the sensor indicates the state in which the injection of the toner from the TRK to the cartridge 1110 is completed, the processor 1140 may confirm whether the refill information is stored in the memory of the TRK. When the refill information is not stored in the memory of the TRK, the processor 1140 may control the TRK to store the refill information in the memory of the TRK.

For example, when the state information indicating the state in which the injection of the toner is completed is obtained while a predetermined operation in a toner refill process is omitted, the processor 1140 may determine that the state information is obtained according to an abnormal refill operation of the TRK. Here, the predetermined operation in the toner refill process may correspond to a predetermined control state of the TRK. The processor 1140 may determine whether to perform the authentication of the TRK based on the omitted predetermined operation. When authentication of the TRK is completed, the processor 1140 may store the refill information in the memory of the TRK.

For example, when the state information indicating the state in which the injection of the toner is completed is obtained immediately after the on state of the image forming apparatus 1100, the processor 1140 may determine that the state information is obtained according to the abnormal refill operation of the TRK.

As another example, the processor 1140 may detect a change from first state information indicating the state in which the TRK is inserted into the image forming apparatus 1100 to second state information indicating the state in which the injection of the toner from the TRK to the cartridge 1110 is completed. The processor 1140 may determine that the change from the first state information to the second state information is obtained according to the abnormal refill operation of the TRK.

For example, the processor 1140 may confirm whether the state in which the TRK is inserted into the image forming apparatus 1100 is included in a predetermined control state of the TRK corresponding to the omitted predetermined operation. When the state in which the TRK is inserted into the image forming apparatus 1100 is included in the predetermined control state of the TRK corresponding to the omitted predetermined operation, the processor 1140 may perform authentication of the TRK.

The processor 1140 may update toner remaining amount information of the cartridge 1110, based on an amount of toner injected into the cartridge 1110 from the TRK. The processor 1140 may control the user interface apparatus 1120 to display the toner remaining amount information.

For example, when the refill information indicating the state in which the injection of the toner is completed is stored in the memory of the TRK, the processor 1140 may unlock a locking apparatus in the image forming apparatus 1000 such that the TRK may be removed from the cartridge 1110.

The processor 1140 may determine, based on the state information, whether the refill operation of the TRK corresponding to the control state is a normal operation according to the toner refill process.

For example, the processor 1140 may determine, based on the toner refill process and previous state information of the sensor, whether a change from the previous state information to the state information indicating the control state is a normal change according to the toner refill process. Here, the state information may be current state information indicating a current control state of the TRK. The processor 1140 may confirm whether there is an omitted operation based on the toner refill process and a state information history of the sensor.

For example, when the previous state information of the sensor indicates a state in which power of the image forming apparatus 1100 is off, and current state information of the sensor indicates a state in which an injection of toner into the cartridge 1110 is completed immediately after a state in which the power of the image forming apparatus 1100 is on, the processor 1140 may determine that an operation to be performed in an insertion state or a docking state of the TRK is omitted and determine that a change of the state information of the sensor is an abnormal change.

As another example, when the previous state information of the sensor indicates that the control state of the TRK indicates the insertion state and the current state information of the sensor indicates the state in which the injection of the toner into the cartridge 1110 is completed, the processor 1140 may determine that an operation to be performed in the docking state of the TRK is omitted, and determine the change of the state information of the sensor as the abnormal change.

When the change from the previous state information to the state information is the abnormal change, the processor 1140 may change the refill operation to an abnormal operation.

When the refill operation is the abnormal operation, the processor 1140 may perform a subsequent operation with respect to the refill operation based on a result of confirming whether the injection of the toner into the cartridge 1110 is completed.

For example, based on a history of the state information of the sensor and the result of confirming that the injection of the toner into the cartridge 1110 is completed, the processor 1140 may determine at least one operation to be omitted in the toner refill process and at least one subsequent operation to perform in the control state such that the toner refill process may be completed.

For example, when the image forming apparatus 1100 senses through the sensor that the power changes from an off state to an on state and the control state of the TRK is changed to a dispensing state immediately after the on state, the processor 1140 may omit an operation to be performed in the insertion state and the docking state of the TRK, and may perform an operation to be performed in the dispensing state. Here, the operation to be performed in the dispensing state may include an existing operation to be performed in the dispensing state when the toner refill process is normally performed, and a complementary operation to be performed in the dispensing state by performing the toner refill process abnormally. For example, the supplementary operation may be an operation to perform re-authentication of the TRK. Then, the processor 1140 may perform an operation to be performed in an undocking state.

As another example, when it is sensed that the control state of the TRK is changed from the insertion state to the dispensing state through the sensor, the processor 1140 may omit an operation to be performed in the docking state of the TRK and may perform the operation to be performed in the dispensing state. Then, the processor 1140 may perform the operation to be performed in the undocking state.

For example, when the injection of the toner into the cartridge 1110 is completed, the processor 1140 may update toner remaining amount information of the cartridge 1110. The processor 1140 may display the updated toner remaining amount information through the user interface apparatus 1120 of the image forming apparatus 1100.

As another example, when the injection of toner into the cartridge 1110 is not completed, the processor 1140 may guide the toner in the TRK to be injected into the cartridge 1110. For example, the processor 1140 may display guide information guiding a method of operating the TRK through the user interface apparatus 1120.

As another example, when the injection of the toner into the cartridge 1110 is completed, the processor 1140 may control the TRK to store a refill completion record in the memory in the completely authenticated TRK. Further, the processor 1140 may unlock a locking apparatus in the image forming apparatus 1100 such that the TRK may be removed from the cartridge 1110.

The above-described operation method of the image forming apparatus 1100 may be embodied in form of a computer-readable recording medium storing computer-executable instructions or data. The above-described examples may be written as computer programs and may be implemented in general-use digital computers that execute the programs using a computer-readable recording medium. Examples of the computer-readable recording medium may include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, a magnetic tape, a floppy disk, a magneto-optical data storage device, an optical data storage device, a hard disk, a solid-state disk (SSD), and any device capable of storing machine readable instructions, related data, a data file, and data structures and providing the machine readable instructions, the related data, the data file, and the data structures to a processor or a computer such that the processor or the computer execute the instruction.

While the disclosure has been particularly shown and described with reference to examples thereof, it will be understood by those of ordinary skill in the art that various changes in form and details may be made therein without departing from the spirit and scope of the disclosure as defined by the following claims. In an example, an appropriate result may be attained even when the above-described techniques are performed in a different order from the above-described method, and/or components, such as the above-described system, structure, device, and circuit, are coupled or combined in a different form from the above-described methods or substituted for or replaced by other components or equivalents thereof.

It should be understood that examples described herein should be considered in a descriptive sense and not for limitation. Descriptions of features within each example should be considered as available for other similar features in other examples. While examples have been described with reference to the figures, it will be understood by those of ordinary skill in the art that various changes in form and details may be made therein without departing from the spirit and scope as defined by the following claims.

What is claimed is:

1. An operation method of an image forming apparatus, the method comprising:

determining a state of a toner refill operation of injecting toner from a toner reload kit (TRK) into a cartridge in the image forming apparatus;

based on completion of injecting toner from the TRK into the cartridge, controlling the TRK to store information indicating a toner refill completion in a memory of the TRK; and based on completion of injecting toner from the TRK into the cartridge, updating information of an amount of remaining toner of the cartridge, based on an amount of the toner injected into the cartridge from the TRK, wherein the determining of the state of the toner refill operation comprises:

obtaining a voltage corresponding to a combined state of the TRK and the image forming apparatus; and determining the state of the toner refill operation based on the obtained voltage.

2. The method of claim 1, wherein the obtaining of the voltage comprises:

obtaining the voltage, based on a resistance determined according to an on state or an off state of an electrical contact in the TRK, wherein a state of the electrical contact is changed to the on state or the off state of the electrical contact based on the combined state of the TRK and the image forming apparatus.

3. The method of claim 1, wherein the state of the toner refill operation includes:

a first state in which the TRK is removed from the image forming apparatus;

a second state in which the TRK is inserted into the image forming apparatus;

a third state in which the TRK is docked in the cartridge such that the toner may be injected into the cartridge;

a fourth state in which the injection of the toner from the TRK into the cartridge is completed; or a fifth state in which the TRK is undocked such that the TRK may be removed from the cartridge.

4. The method of claim 1, wherein the controlling of the TRK to store the information indicating the toner refill completion in the memory of the TRK comprises:

based on completion of injecting toner from the TRK into the cartridge, determining whether the information indicating the toner refill completion is stored in the memory of the TRK; and based on determining that refill information indicating the toner refill completion is not stored in the memory of the TRK, storing the information indicating the toner refill completion in the memory of the TRK.

5. The method of claim 1, wherein the controlling of the TRK to store the information indicating the toner refill completion in the memory of the TRK comprises:

based on completion of injecting toner from the TRK into the cartridge, determining an operation, among operations, was omitted during the toner refill operation;

based on determining the omitted operation, authenticating the TRK; and based on successful authentication of the TRK, storing the information indicating the toner refill completion in the memory of the TRK.

6. The method of claim 5, wherein, based on completion of injecting toner from the TRK into the cartridge, the determining the operation, among operations, was omitted during the toner refill operation comprises:

based on the state of the toner refill operation changing to a state in which the injection of the toner is completed after an on state of the image forming apparatus, determining an operation from a toner insertion state to the state in which the injection of the toner is completed was omitted.

7. The method of claim 1, wherein the controlling of the TRK to store the information indicating the toner refill completion in the memory of the TRK comprises:

based on a state in which the TRK is inserted into the image forming apparatus changing to a state in which the injection of the toner from the TRK to the cartridge is completed, determining an operation of docking the TRK to the cartridge was omitted; and determining whether the information indicating the toner refill completion is stored in the memory of the TRK.

8. The method of claim 1, further comprising:

based on the information indicating the toner refill completion being stored in the memory of the TRK, unlocking a locking apparatus in the image forming apparatus so the TRK may be removed from the cartridge.

9. A non-transitory computer-readable recording medium having recorded thereon instructions executable by a processor, the instructions to cause the processor to:

determine a state of a toner refill operation of injecting toner from a toner reload kit (TRK) into a cartridge in an image forming apparatus;

based on completion of injecting toner from the TRK into the cartridge, control the TRK to store information indicating a toner refill completion in a memory of the TRK; and based on completion of injecting toner from the TRK into the cartridge, update information of an amount of remaining toner of the cartridge, based on an amount of the toner injected into the cartridge from the TRK, wherein the processor is to determine the state of the toner refill operation by:

obtaining a voltage corresponding to a combined state of the TRK and the image forming apparatus; and determining the state of the toner refill operation based on the obtained voltage.

10. An image forming apparatus comprising:

a user interface device to display information of an amount of remaining toner of a cartridge from a toner reload kit (TRK);

a processor; and a memory storing instructions executable by the processor, wherein the processor is to execute the instructions to, obtain a voltage corresponding to a combined state of the TRK and the image forming apparatus;

determine a state of a toner refill operation of injecting toner from the TRK into a cartridge in the image forming apparatus based on the obtained voltage;

based on completion of injecting toner from the TRK into the cartridge, control the TRK to store information indicating a toner refill completion in a memory of the TRK; and based on completion of injecting toner from the TRK into the cartridge, update the information of an amount of remaining toner of the cartridge, based on an amount of the toner injected into the cartridge from the TRK.

11. The image forming apparatus of claim 10, wherein the processor is to further execute the instructions to, based on completion of injecting toner from the TRK into the cartridge, determine an operation, among operations, was omitted during the toner refill operation;

based on determining the omitted operation, authenticate the TRK; and based on successful authentication of the TRK, store the information indicating the toner refill completion in the memory of the TRK.

12. The image forming apparatus of claim 11, wherein the processor is to further execute the instructions to, based on the state of the toner refill operation changing to a state in which the injection of the toner is completed after an on state of the image forming apparatus, determine an operation from a toner insertion state to the state in which the injection of the toner is completed was omitted.

13. The image forming apparatus of claim 10, further comprising:

a locking apparatus to fix the TRK to the cartridge, wherein the processor is to further execute the instructions to, based on the information indicating the toner refill completion being stored in the memory of the TRK, unlock the locking apparatus so the TRK may be removed from the cartridge.

14. The image forming apparatus of claim 10, wherein the processor is to further execute the instructions to obtain the voltage based on a resistance determined according to an on state or an off state of an electrical contact in the TRK, wherein a state of the electrical contact is changed to the on state or the off state of the electrical contact based on the combined state of the TRK and the image forming apparatus.

15. The image forming apparatus of claim 10, wherein the state of the toner refill operation includes:

a first state in which the TRK is removed from the image forming apparatus;

a second state in which the TRK is inserted into the image forming apparatus;

a third state in which the TRK is docked in the cartridge such that the toner may be injected into the cartridge;

a fourth state in which the injection of the toner from the TRK into the cartridge is completed; or a fifth state in which the TRK is undocked such that the TRK may be removed from the cartridge.

16. The image forming apparatus of claim 10, wherein the processor is to further execute the instructions to, based on completion of injecting toner from the TRK into the cartridge, determine whether the information indicating the toner refill completion is stored in the memory of the TRK; and based on determining that refill information indicating the toner refill completion is not stored in the memory of the TRK, store the information indicating the toner refill completion in the memory of the TRK.

17. The image forming apparatus of claim 10, wherein the processor is to further execute the instructions to, based on a state in which the TRK is inserted into the image forming apparatus changing to a state in which the injection of the toner from the TRK to the cartridge is completed, determine an operation of docking the TRK to the cartridge was omitted; and determine whether the information indicating the toner refill completion is stored in the memory of the TRK.

* * * * *